US008353113B2

(12) United States Patent
Kitamoto et al.

(10) Patent No.: US 8,353,113 B2
(45) Date of Patent: Jan. 15, 2013

(54) DRYING DEVICE

(75) Inventors: Hiroko Kitamoto, Hiroshima (JP); Keiichi Sato, Hiroshima (JP); Naohiko Matsuda, Hiroshima (JP); Masahiro Sugihara, Hiroshima (JP)

(73) Assignee: Mitsubishi Heavy Industries, LTD., Tokyo (JP)

( * ) Notice: Subject to any disclaimer, the term of this patent is extended or adjusted under 35 U.S.C. 154(b) by 308 days.

(21) Appl. No.: 12/749,757

(22) Filed: Mar. 30, 2010

(65) Prior Publication Data

US 2010/0269366 A1 Oct. 28, 2010

(30) Foreign Application Priority Data

Apr. 28, 2009 (JP) ..... 2009-109790

(51) Int. Cl.
*F26B 3/30* (2006.01)
*F26B 3/04* (2006.01)
*F26B 13/00* (2006.01)

(52) U.S. Cl. ..... 34/267; 34/638; 34/639; 34/643

(58) Field of Classification Search ..... 34/618, 34/619, 629, 638, 639, 641, 643, 266, 267
See application file for complete search history.

(56) References Cited

U.S. PATENT DOCUMENTS 2,492,974 A * 1/1950 Dungler ..... 34/643
4,290,210 A * 9/1981 Johansson ..... 34/643
5,471,766 A * 12/1995 Heikkila et al. ..... 34/461

FOREIGN PATENT DOCUMENTS

| | | | |
|---|---|---|---|
| EP | 508254 | A1 * | 10/1992 |
| JP | 58-002576 | A | 1/1983 |
| JP | 1-156775 | U | 10/1989 |
| JP | 5-008372 | A | 1/1993 |
| JP | 5-69194 | U | 9/1993 |
| JP | 3882392 | B2 | 2/2007 |
| JP | 3953911 | B2 | 8/2007 |

OTHER PUBLICATIONS

Japanese Office Action (Notice of Allowance) dated Feb. 1, 2011, issued in corresponding Japanese Patent Application No. 2009-109790.

* cited by examiner

*Primary Examiner* — Jiping Lu
(74) *Attorney, Agent, or Firm* — Westerman, Hattori, Daniels & Adrian, LLP

(57) ABSTRACT

A drying device including: a travelling unit and a drying unit. The travelling unit transports a sheet-like substrate in a travelling direction. The sheet-like substrate includes a thin film body wherein at least one surface of the thin film body is coated with a coating material including an active material. The drying unit dries the thin film body. The drying unit includes a radiative heater and a first nozzle. The radiative heater irradiates an infrared ray to a to-be-dried surface of the thin film body. The first nozzle blows a dry air to the to-be-dried surface in a direction opposite to the travelling direction of the sheet-like substrate.

11 Claims, 5 Drawing Sheets

DRYING DEVICE

BACKGROUND OF THE INVENTION

The present application claims priority on Japanese Patent Application No. 2009-109790, filed Apr. 28, 2009, the content of which is incorporated herein by reference.

FIELD OF THE INVENTION

The present invention relates to a drying device which can efficiently dry a thin film sheet applicable to a lithium secondary battery.

DESCRIPTION OF THE RELATED ART

It is well known that a manufacturing process of an electrode for a lithium secondary battery includes a coating step and a drying step. In the coating step, a substrate is coated with a predetermined coating material. In the drying step, a coating film is formed by drying the coating material which was applied to the substrate. During this drying step, the moisture in the coating film needs to be dried sufficiently in order to attain the designed features.

Japanese Patent No. 3882392 (hereinafter referred to as Patent Document 1) describes a technology involving a manufacturing process of an electrode for a lithium secondary battery including a coating step and a drying step. In the coating step, a coating material including an active material, a conductive material, a binder, and a solvent is applied to a substrate of a conductive electrode. In the drying step, a coating film is formed by drying the coating material which was applied to the substrate. The technology described in Patent Document 1 relates to a time setting of the drying process, aiming to enhance the adhesiveness between the substrate of the conductive electrode and the electrode material layer. Patent Document 1 also describes a drying method which dries the moisture in the coating film by circulating hot air.

Meanwhile, Japanese Patent No. 3953911 (hereinafter referred to as Patent Document 2) describes a manufacturing device of an electrode plate for a secondary battery. As shown in FIG. 5, the manufacturing device includes an unwinding device 101, a winding device 102, a coating device 103, and a drying device 104. The unwinding device 101 sends out a collector 100 which is in the form of a thin film and is wrapped up in a roll. The winding device 102 winds up the collector 100. The coating device 103 coats the collector 100 with a coating material. The drying device 104 dries the collector 100 which was coated by the coating device 103. A plurality of infrared heaters 105 are placed inside the drying device 104 along the direction in which the collector 100 is transported. In addition, a plurality of hot air nozzles 106 are placed inside the drying device 104 opposite to the infrared heaters 105.

According to the drying device 104 described in Patent Document 2, the collector 100 is heated from above by the plurality of infrared heaters 105, as shown in FIG. 5. The collector 100 is also dried from below by the plurality of hot air nozzles 106 placed opposite to the infrared heaters 105. However, by using the drying device 104 configured as described above, the collector 100 might be dried in an uneven manner. Furthermore, there is a problem in that the moisture, which once evaporated, might stick again to the collector 100.

Moreover, Patent Document 1 and Patent Document 2 both present a problem in that a large amount of energy is consumed due to the inefficiency in drying.

SUMMARY OF THE INVENTION

The present invention is made considering the problems described above. Accordingly, an object of the present invention is to provide a drying device which prevents the moisture from reattaching to a thin film body, dries evenly, and therefore minimizes the amount of energy necessary for the drying.

Namely, a drying device according to an aspect of the present invention includes a travelling unit and a drying unit. The travelling unit transports a sheet-like substrate in a travelling direction. The sheet-like substrate includes a thin film body wherein at least one surface of the thin film body is coated with a coating material including an active material. The drying unit dries the thin film body. The drying unit includes a radiative heater and a first nozzle. The radiative heater irradiates an infrared ray to a to-be-dried surface of the thin film body. The first nozzle blows a dry air to the to-be-dried surface in a direction opposite to the travelling direction of the sheet-like substrate.

According to this configuration, the drying device includes a radiative heater, which irradiates infrared rays to a to-be-dried surface of the thin film body, and also includes a first nozzle, which blows dry air in a direction opposite to the direction in which the sheet-like substrate is transported (hereinafter, may be referred to as the "travelling direction"). As a result, air which includes the evaporated moisture is removed from the to-be-dried surface due to the dry air blown by the first nozzle.

In addition, since the dry air from the first nozzle is blown in a direction opposite to the travelling direction, it is possible to constantly increase the dryness of the thin film body at the lower stream of the transportation of the substrate.

Furthermore, even if the evaporated moisture reattaches to the thin film body, the moisture can be evaporated again by the dry air blown in a direction opposite to the direction in which the sheet-like substrate is transported. Then, the air including this moisture can be sent to a direction opposite to the direction in which the sheet-like substrate is transported.

As a result, the overall drying process can be performed evenly regardless of the position on the thin film body which is dried. In addition, the efficiency of the drying process can be enhanced. Consequently, it is possible to minimize the amount of energy necessary to dry the thin film body.

In addition, the above drying device may further include a first air discharging unit in an upper stream side of the travelling direction. The first air discharging unit discharges the dry air blown to the to-be-dried surface.

According to this configuration, a first air discharging unit is placed in an upper stream of the direction in which the sheet-like substrate is transported. The first air discharging unit discharges the dry air blown from the first nozzle. As a result, the air, which includes a relatively large amount of moisture after passing by the to-be-dried surface, is effectively discharged to the exterior of the drying device.

In addition, the above drying device may further include a first drying unit. The first drying unit includes the radiative heater and the first nozzle. The radiative heater is provided in an upper stream side of the travelling direction. The first nozzle is provided in a lower stream side of the travelling direction.

According to this configuration, the drying device includes a first drying unit comprising a radiative heater in the upper stream of the travelling direction and a first nozzle in the lower stream of the travelling direction. Thus, the moisture, which evaporated from the thin film body by being heated by the radiative heater, is sent to the upper stream of the travelling direction by the dry air blown from the first nozzle. In other words, the evaporated moisture is sent to a wet area which is not affected by the reattachment of moisture. Thus, the dry area is kept dry. In this way, the moisture is prevented from reattaching to the dried, lower stream portion of the thin film body. Consequently, the efficiency of the drying process can be greatly improved.

In addition, the above drying device may further include a plurality of first drying units provided in series along the travelling direction.

According to this configuration, the drying device includes a plurality of first drying units. Thus, the efficiency of the drying process can be improved even further by drying the air progressively from the upper stream of the travelling direction to the lower stream.

Furthermore, a drying device according to an embodiment of the present invention includes a travelling unit and a drying unit. The travelling unit transports a sheet-like substrate in a travelling direction. The sheet-like substrate includes a thin film body. At least one surface of the thin film body is coated with a coating material including an active material. The drying unit dries the thin film body. The drying unit includes a radiative heater and a second nozzle. The radiative heater irradiates an infrared ray to a to-be-dried surface of the thin film body. The second nozzle blows a dry air to the to-be-dried surface from an inner side of a width direction perpendicular to the travelling direction of the sheet-like substrate towards an outer side of the width direction.

According to this configuration, the drying device includes a radiative heater, which irradiates infrared rays to a to-be-dried surface of the thin film body, and a second nozzle, which blows dry air from the inner side of the width direction of the thin film body to the outer side. Thus, the air including the evaporated moisture can be quickly removed from the to-be-dried surface towards the outer side of the width direction of the thin film body, due to the dry air from the second nozzle. Consequently, the evaporated moisture is prevented from reattaching to the thin film body.

In this way, the overall drying process can be performed evenly regardless of the position on the thin film body which is dried. In addition, the efficiency of the drying process can be enhanced. Consequently, it is possible to minimize the amount of energy necessary to dry the thin film body.

In addition, the above drying device may be configured as follows: the second nozzle blows the dry air to the to-be-dried surface in a direction opposite to the travelling direction.

According to this configuration, the dry air from the second nozzle is blown towards a direction opposite to the direction in which the sheet-like substrate is transported. As a result, it is possible to increase the dryness of the thin film body at the lower stream of the travelling direction.

Furthermore, even if the evaporated moisture reattaches to the thin film body, the moisture can be evaporated again by the dry air. Then, the air including this moisture can be sent to a direction opposite to the direction in which the sheet-like substrate is transported.

As a result, the unevenness of the drying can be prevented more effectively. Thus, the drying process can be performed more evenly and efficiently.

In addition, the above drying device may further include a second drying unit. The second drying unit includes the radiative heater and the second nozzle. The radiative heater is provided in an upper stream side of the travelling direction. The second nozzle is provided in a lower stream side of the travelling direction.

According to this configuration, the drying device includes a second drying unit comprising a radiative heater in the upper stream of the travelling direction and a second nozzle in the lower stream of the travelling direction. Thus, moisture which was heated by the radiative heater and evaporated from the thin film body is quickly sent to the lateral side of the width direction of the thin film body by the dry air blown from the second nozzle. In other words, by keeping the dry area dry, the moisture is prevented from reattaching to the dry, lower stream portion of the thin film body. As a result, the efficiency of the drying process can be greatly improved.

In addition, the above drying device may further include a plurality of second drying units provided in series along the travelling direction.

According to this configuration, a plurality of second drying units are provided. Therefore, the drying process can be made even more efficient.

In addition, the above drying device may further include a second air discharging unit in the outer side of the width direction of the sheet-like substrate. The second air discharging unit discharges the dry air blown to the to-be-dried surface.

According to this configuration, a second air discharging unit is provided in the outer side of the width direction of the sheet-like substrate, in order to discharge the dry air which passed through the to-be-dried surface. Consequently, the damp air sent by the second nozzle can be discharged to the exterior of the drying device with certainty.

In addition, the above drying device may further include a first drying unit. The first drying unit includes the radiative heater and the first nozzle. The radiative heater is provided in the upper stream side of the travelling direction. The first nozzle is provided in the lower stream side of the travelling direction. This first nozzle blows a dry air to the to-be-dried surface in a direction opposite to the travelling direction of the sheet-like substrate. The first drying unit is provided in a lower stream side of the travelling direction compared to the second drying unit.

According to this configuration, the drying device includes a first drying unit which is provided in a lower stream portion of the travelling direction compared to the second drying unit. As a result, the dryness of the thin film body in the width direction can be enhanced evenly immediately before the drying process is completed. Thus, it is possible to further reduce the unevenness in the drying of the thin film body in the width direction.

In addition, the above drying device may further include a first air discharging unit in the upper stream side of the travelling direction. The first air discharging unit discharges the dry air blown to the to-be-dried surface.

According to this configuration, a first air discharging unit is provided in the upper stream of the travelling direction of the sheet-like substrate in order to discharge the dry air blown from the first nozzle. As a result, the air including a relatively large amount of moisture can be discharged to the exterior of the drying device in an efficient manner.

In addition, the above drying device may further include an air flow supplying nozzle blowing an air to a lower surface of the sheet-like substrate.

According to this configuration, the drying device includes an air flow supplying nozzle which blows air to a lower surface of the sheet-like substrate. Due to the air flow supplied from the air flow supplying nozzle, the sheet-like substrate can be transported in a stable manner while being lifted slightly.

In addition, the above drying device may be configured as follows: the drying unit is provided inside a dry space retaining structure. The dry space retaining structure forms a dry space in which the thin film body is dried.

According to this configuration, the drying unit is provided inside the dry space retaining structure. As a result, a certain level of dryness can be maintained inside the dry space retaining structure.

Furthermore, the size of the dry space retaining structure can be reduced. Accordingly, the operating cost necessary for drying the interior of the dry space retaining structure can be reduced as well.

In addition, the above drying device may be configured as follows: the travelling unit is provided inside the dry space retaining structure.

According to this configuration, even if the maintenance operations are performed, the moisture is prevented from reattaching to the dried to-be-dried surface.

As described above, according to the present invention, the moisture is prevented from reattaching to the thin film body, the drying process is conducted evenly, and therefore, the amount of energy necessary for the drying is minimized.

DETAILED DESCRIPTION OF THE PREFERRED EMBODIMENTS

Hereinafter a drying device according to an aspect of the present invention is described with reference to the attached figures.

(1) First Embodiment

Figure 1A:
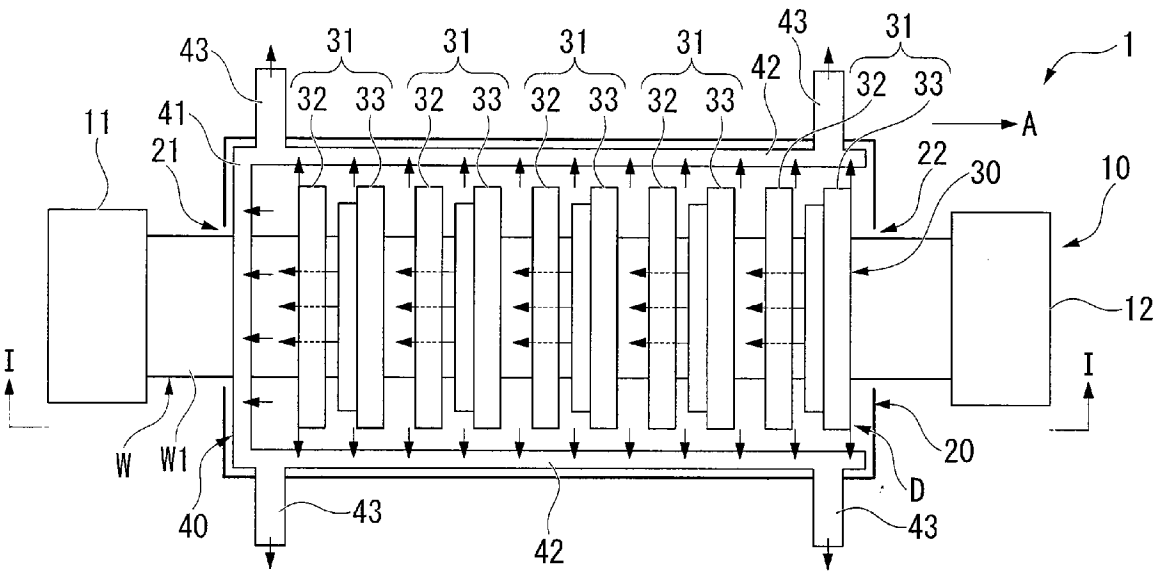
FIG. 1A is a skeletal configuration diagram (plane view) of a drying device 1 according to a first embodiment of the present invention.
Figure 1B:
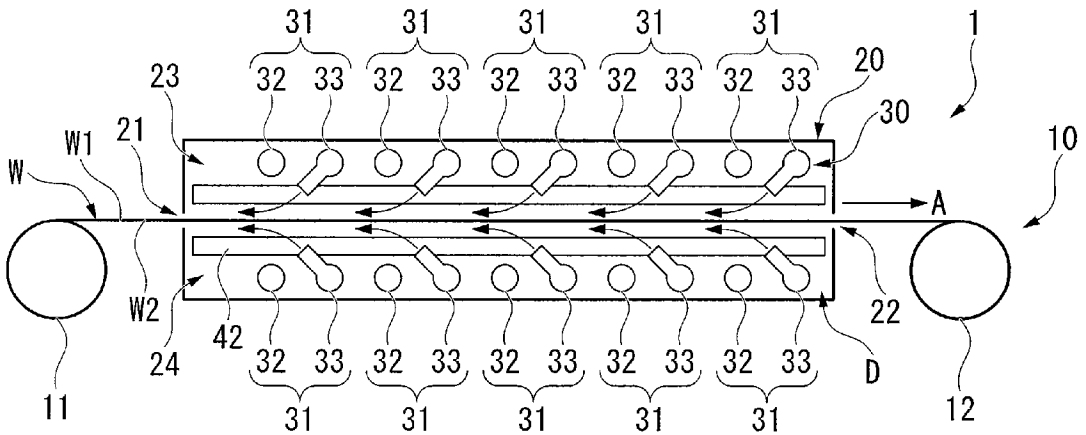
FIG. 1B is a skeletal configuration diagram (cross sectional view along line I-I) of a drying device 1 according to a first embodiment of the present invention.

FIGS. 1A and 1B represent skeletal configuration diagrams of the drying device 1 according to a first embodiment of the present invention. FIG. 1A shows a plane view, while FIG. 1B shows a cross-sectional view across line I-I.

The drying device 1 is used in a drying process which is included in a manufacturing process of an electrode of a lithium secondary battery. The drying device 1 dries a coated film of a sheet-like substrate W. A coating material including an active material is coated on both sides (i.e., to-be-dried surfaces W1 and W2) of the sheet-like substrate W.

As shown in FIG. 1, the drying device 1 includes a travelling unit 10, a dry space retaining structure 20, a drying unit 30, and an air discharging device 40.

As shown in FIG. 1, the travelling unit 10 includes a feeding roller 11, which sends out the sheet-like substrate W, and a winding roller 12, which winds up the sheet-like substrate W. The travelling unit 10 is configured so that the driving of the feeding roller 11 and the winding roller 12 allows the sheet-like substrate W to travel in one direction A (hereinafter, referred to as a travelling direction A). The mechanism with which the feeding roller 11 and the winding roller 12 are driven is not diagrammed.

The dry space retaining structure 20 is shaped like a box, and includes a dry space D in the interior of the dry space retaining structure 20. The moisture of the dry space D can be adjusted.

An inlet 21 is formed on one end wall of the dry space retaining structure 20 in the longitudinal direction. An outlet 22 is formed on another end wall of the dry space retaining structure 20 in the longitudinal direction. The longitudinal direction of the dry space retaining structure 20 is set to be parallel to the travelling direction A. The sheet-like substrate W is fed into the dry space D from the inlet 21. The sheet-like substrate W is discharged towards the winding roller 12 from the outlet 22.

According to this configuration, the sheet-like substrate W undergoes a drying process while travelling in the travelling direction A in the dry space D.

The drying unit 30 is structured so that five first drying units 31 are placed in series along the travelling direction A on both a ceiling part 23 and a floor part 24 of the dry space retaining structure 20.

Each of the first drying unit 31 includes a radiative heater 32 and a first nozzle 33. The radiative heater 32 is placed in an upper stream side of the travelling direction A. The first nozzle 33 is placed in a lower stream side.

The radiative heater 32 causes moisture to be evaporated rapidly by irradiating infrared rays to the to-be-dried surfaces W1 and W2 of the sheet-like substrate W. The radiative heater 32 is elongated. The longitudinal direction of the radiative heater 32 is perpendicular to the travelling direction A. In other words, the radiative heater 32 is placed along the entire width of the sheet-like substrate W. Thus, it is possible to irradiate the entire width of the sheet-like substrate W with infrared rays.

The first nozzle 33 blows a dry air, supplied from a dry air supplying source (not diagrammed), towards a direction opposite to the travelling direction A to the to-be-dried surface W1 from an upper side, and to the to-be-dried surface W2 from the lower side.

The amount of air blown from the first nozzle 33 on the floor part 24 is adjusted, so that the first nozzle 33 can function as an air flow supplying nozzle which makes the sheet-like substrate W float, by blowing air to the to-be-dried surface W2 which is the lower surface of the sheet-like substrate W.

The air discharging device 40 is structured by a tube body placed in an interior wall of the dry space retaining structure 20 so as to surround the dry space D. The air discharging device 40 includes a front portion discharging unit (a first air discharging unit) 41 and a side portion discharging unit (a second air discharging unit) 42. The front portion discharging unit 41 is placed in the most upper stream side of the travelling direction A. The side portion discharging unit 42 extends along the travelling direction A, and is placed in an upper side and a lower side of an inner side wall at both sides of the width direction of the sheet-like substrate W.

Incidentally, the side portion discharging unit 42 is connected with a plurality of discharging tubes 43. The discharging tubes 43 discharge the air, flown into the air discharging device 40, to an exterior portion.

Next, a drying process of the sheet-like substrate W using the drying device 1 is described.

First, the feeding roller 11 and the winding roller 12 of the travelling unit 10 are activated. Then, the sheet-like substrate W travels in the travelling direction A in the dry space D of the dry space retaining structure 20. At this time, a coating material is applied to the to-be-dried surfaces W1 and W2 of the sheet-like substrate W which is fed into the dry space D from the inlet 21.

Each of the first drying units 31 irradiates infrared rays from the radiative heater 32 to the to-be-dried surface W1 of the sheet-like substrate W send from the upper stream side, and evaporates the moisture. Then, the first nozzle blows dry air to the to-be-dried surface W1. Then, moisture further evaporates from the to-be-dried surface W1. In addition, the dry air flows towards the upper stream side. At this time, the air located over the to-be-dried surface W1 includes moisture which was evaporated using the infrared rays. This damp air is pushed towards the upper stream side by the dry air.

The drying effect described above occurs in series in a line along the travelling direction A. As a result, the more the sheet-like substrate W travels towards the lower stream side, the drier the to-be-dried surface W1 becomes. In other words, the evaporated moisture moves towards the lower stream side, and is prevented from stagnating above the to-be-dried surface W1 . In addition, the evaporated moisture is prevented from reattaching to the to-be-dried surface W1 as the sheet-like substrate W travels towards the upper stream side. Furthermore, the drying process is facilitated because the amount of evaporation from the to-be-dried surface W1 increases.

The "dry air" which includes a large amount of the evaporated moisture is sucked in by the front portion discharging unit 41, and is discharged towards the outside via the discharging tube 43. As a result, moisture will not accumulate in the interior portion. Therefore, dry air is constantly supplied while the drying device 1 is operating. Consequently, the distribution of moisture in the travelling direction A becomes approximately even, regardless of the operating time. Incidentally, air is discharged towards the outside from the side portion discharging unit 42 as well.

The to-be-dried surface W2 is dried in the same manner as the to-be-dried surface W1. However, in addition, the first nozzle 33 on the floor part 24 blows air to the to-be-dried surface W2. Consequently, the sheet-like substrate W floats.

In these ways, the to-be-dried surfaces W1 and W2 are dried well. The sheet-like substrate W is discharged from the outlet 22, and is wrapped up by the winding roller 12. The sheet-like substrate W, dried as described above, retains the designed features in a sufficient manner.

As described above, the drying device 1 includes a radiative heater 32, which irradiates infrared rays to the to-be-dried surfaces W1 and W2 of the sheet-like substrate W, and a first nozzle 33, which blows dry air in a direction opposite to the travelling direction A of the sheet-like substrate W. As a result, damp air which includes the evaporated moisture is removed from above the to-be-dried surfaces W1 and W2 due to the dry air blown by the first nozzle 33.

In addition, the first nozzle 33 blows the dry air in a direction opposite to the travelling direction A. As a result, the dryness of the sheet-like substrate W can constantly be kept high.

In addition, even though the evaporated moisture reattaches to the sheet-like substrate W, the moisture can be evaporated again by the dry air blown in a direction opposite to the travelling direction A of the sheet-like substrate W. Then, the air including this re-evaporated moisture can be sent to a direction opposite to the traveling direction A of the sheet-like substrate W.

As a result, the sheet-like substrate W is dried evenly in general, regardless of the location that is dried. Thus, the drying process can be performed evenly and efficiently. Consequently, the amount of energy necessary for drying the sheet-like substrate W can be minimized.

In addition, the front portion discharging unit 41 is provided in an upper stream side of the travelling direction A of the sheet-like substrate W in order to discharge the dry air blown from the first nozzle 33. As a result, air which includes a relatively large amount of moisture after passing by the to-be-dried surfaces W1 and W2 can be efficiently discharged to the outside.

In addition, the drying device 1 includes a first drying unit 31 comprising a radiative heater 32 in the upper stream side of the travelling direction A and a first nozzle 33 in the lower stream side of the travelling direction A. Thus, the moisture, which evaporated from the sheet-like substrate W by being heated by the radiative heater 32, is sent to the upper stream side of the travelling direction A of the sheet-like substrate W by the dry air blown from the first nozzle 33. In other words, the evaporated moisture is sent to a damp area which is not affected by the reattachment of moisture. In this way, the dryness of the dry area is maintained. Hence, the moisture is prevented from reattaching to the dried, lower stream portion of the sheet-like substrate W. As a result, the efficiency of the drying process can be greatly improved.

In addition, the drying device 1 includes a plurality of first drying units 31 which are placed in series in the travelling direction. Thus, the drying process can be made even more efficient by lowering the humidity of the air progressively from the upper stream side of the travelling direction A towards the lower stream side.

In addition, the first nozzle 33 placed on the floor part of the dry space retaining structure 20 functions as an air flow supplying nozzle which blows air to the lower surface (the to-be-dried surface W2) of the sheet-like substrate W. Thus, the sheet-like substrate W floats due to the air flow supplied by the first nozzle 33. As a result, the sheet-like substrate W can be transported in a stable manner.

In addition, the drying device 1 includes a radiative heater 32 and a first nozzle 33 in the dry space D in which the sheet-like substrate W is dried. Therefore, the size of the dry space D can be reduced. Moreover, the operating cost necessary for drying the dry space D can be reduced.

Incidentally, according to the first embodiment described above, five first drying units 31 were provided, as shown in FIG. 1, on each of the ceiling part 23 and the floor part 24. However, the number of the first drying units 31 is not limited to five.

(Variation of the First Embodiment)

Figure 2A:
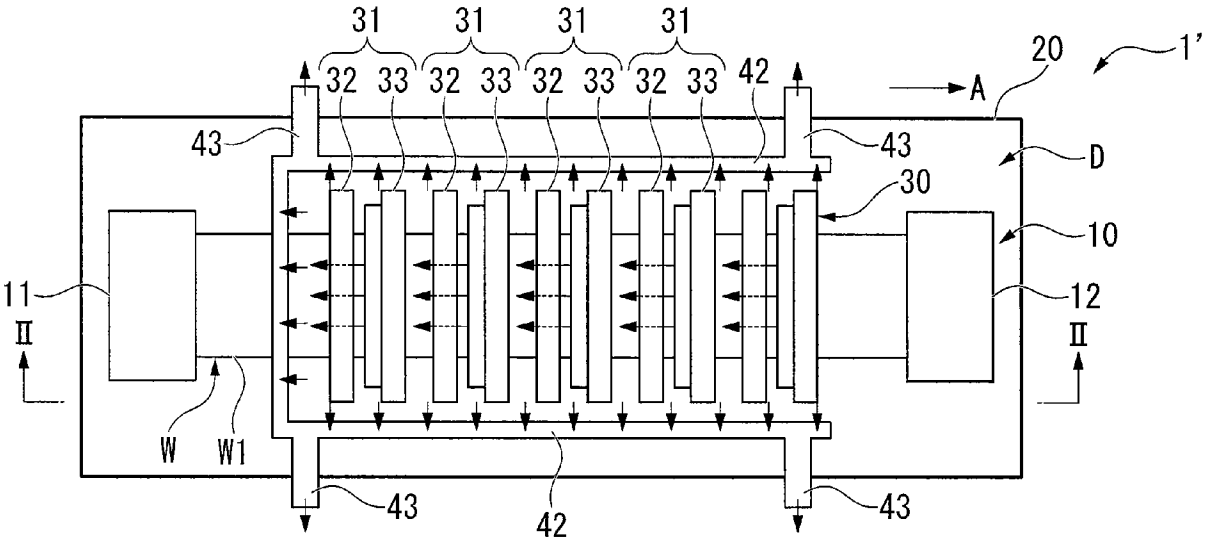
FIG. 2A is a skeletal configuration diagram (plane view) of a drying device 1' according to a variation of a first embodiment of the present invention.
Figure 2B:
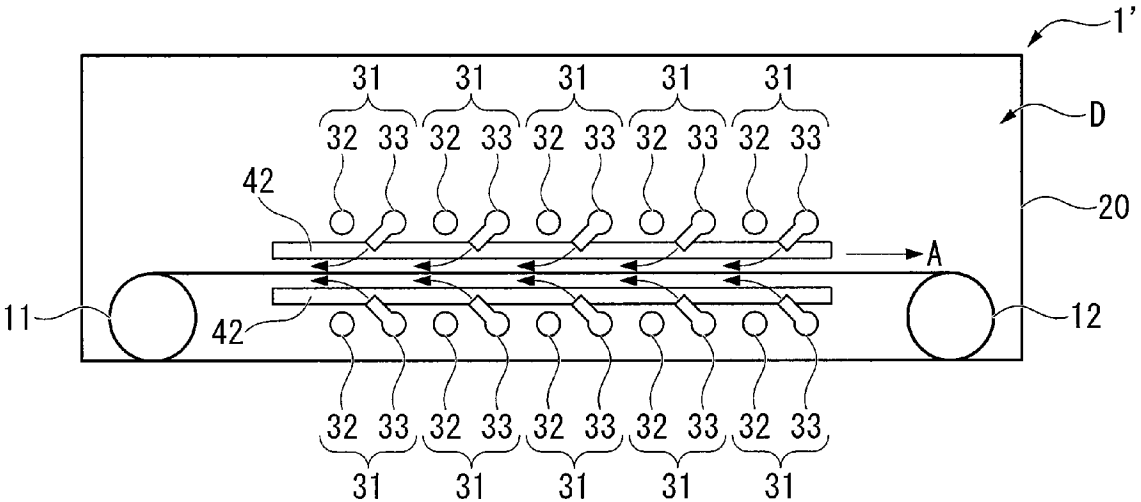
FIG. 2B is a skeletal configuration diagram (cross sectional view along line II-II) of a drying device 1' according to a variation of a first embodiment of the present invention.

FIGS. 2A and 2B represent skeletal configuration diagrams of a drying device 1' according to a variation of the first embodiment. FIG. 2A is a plane view, while FIG. 2B is a cross-sectional view along line II-II.

The drying device 1 according to the first embodiment described above includes a travelling unit 10 placed outside the dry space retaining structure 20. However, the drying device 1' according to the variation of the first embodiment is structured so that the travelling unit 10 (including the feeding roller 11 and the winding roller 12) is provided in the dry space D.

In this way, the drying device 1' includes both the drying unit 30 and the travelling unit 10 in the dry space D. Thus, even if maintenance operations are performed, moisture is prevented from reattaching to the dried to-be-dried surfaces W1 and W2.

Furthermore, it is possible to heat the feeding roller 11 in advance before executing the drying process conducted by the radiative heater 32 and the first nozzle 33. In addition, the moisture is prevented from re-attaching to the winding roller 12 after the drying process is completed. In addition, a preparatory operation of the drying process can be conducted, as well as maintenance operations.

(Second Embodiment)

Figure 3A:
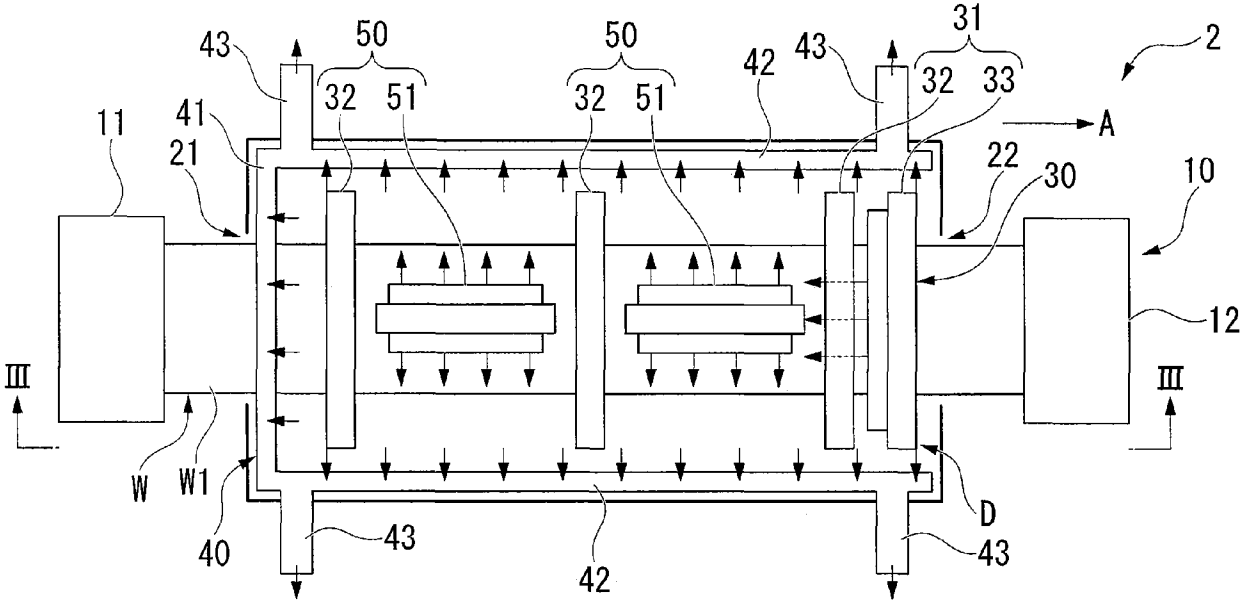
FIG. 3A is a skeletal configuration diagram (plane view) of a drying device 2 according to a second embodiment of the present invention.
Figure 3B:
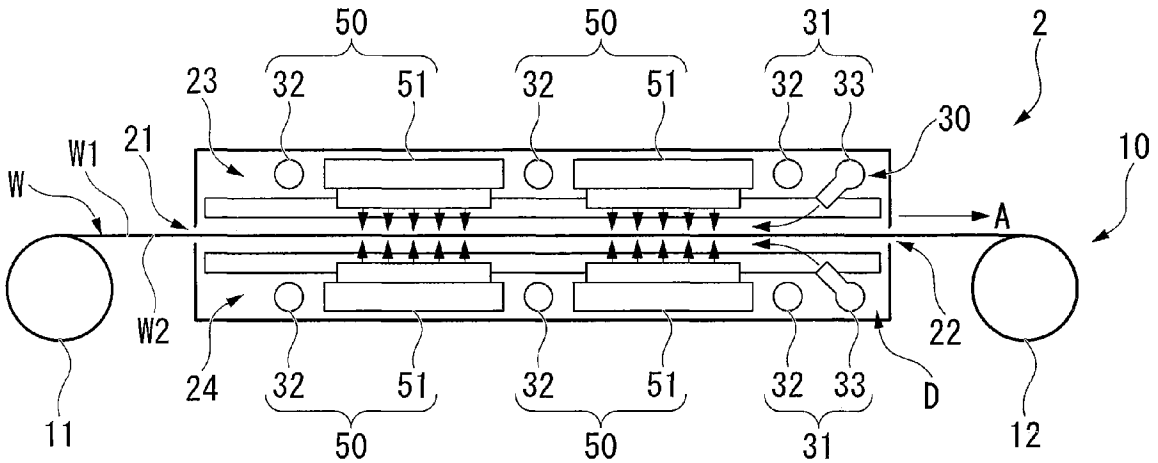
FIG. 3B is a skeletal configuration diagram (cross sectional view along line III-III) of a drying device 2 according to a second embodiment of the present invention.

FIGS. 3A and 3B represent skeletal configuration diagrams of a drying device 2 according to a second embodiment of the present invention. FIG. 3A is a plane view, while FIG. 3B is a cross-sectional view along line III-III. Components which are included in FIGS. 3A-3B as well as FIGS. 1A-2B are referred to using the same reference numeral. Descriptions of overlapping components are omitted.

As shown in FIGS. 3A and 3B, the drying device 2 includes two second drying units 50 and one first drying unit 31 in each of the ceiling part 23 and the floor part 24 of the dry space retaining structure 20.

The second drying unit 50 includes a radiative heater 32 and a second nozzle 51. The second nozzle 51 blows dry air to the to-be-dried surfaces W1 and W2.

As shown in FIG. 3A, the second nozzle 51 is elongated. The longitudinal direction of the second nozzle 51 is parallel to the travelling direction A. The second nozzle 51 is placed near the center of the width direction of the sheet-like substrate W.

According to this configuration, dry air is blown to the to-be-dried surfaces W1 and W2 from the inner side of the sheet-like substrate W towards the outer side of the sheet-like substrate W.

The amount of air blown from the second nozzle 51 is adjusted so that the second nozzle 51 on the floor portion 24 blows air to the to-be-dried surface W2, which is a lower surface of the sheet-like substrate W. In this way, the second nozzle 51 on the floor portion 24 functions as an air flow supplying nozzle which allows the sheet-like substrate W to float.

The first drying unit 31 is placed in the most lower stream side in both the ceiling portion 23 and the floor portion 24 of the dry space retaining structure 20.

In these ways, the drying device 2 includes the radiative heater 32 and the second nozzle 51 which blows dry air from the inner side of the width direction of the sheet-like substrate W towards the outer side of the width direction. As a result, the damp air including the evaporated moisture can be quickly removed by the dryer towards the outer side of the width direction of the sheet-like substrate W from above the to-be-dried surfaces W1 and W2. In this way, the evaporated moisture is prevented from reattaching to the sheet-like substrate W.

Consequently, the drying process as a whole can be conducted evenly regardless of the location on the sheet-like substrate W that is dried. Thus, the sheet-like substrate W can be dried evenly and efficiently. As a result, it is possible to minimize the amount of energy necessary to dry the sheet-like substrate W.

In addition, the drying device 2 includes a second drying unit 50 comprising a radiative heater 32 in the upper stream side of the travelling direction and a second nozzle 51 in the lower stream side. Thus, the moisture which evaporated from the sheet-like substrate W by being heated with the radiative heater 32 can be sent swiftly to the outer side of the width direction of the sheet-like substrate W by the dry air blown from the second nozzle 51. In other words, by maintaining the dryness of the dry portion, moisture is prevented from reattaching to the dried, lower stream portion of the sheet-like substrate W. Consequently, the effectiveness of the drying process can be greatly enhanced.

In addition, a plurality of second drying units 50 are provided in series along the travelling direction. Thus, the drying process can be conducted over a long distance. Therefore, the drying process can be made even more effective.

Furthermore, the second nozzle 51 according to the second embodiment is elongated. As a result, compared to the first embodiment described above, it is possible to conduct the drying process over a long distance with only a small number of nozzles. Thus, the structure of the drying device 2 becomes simpler.

In addition, the drying device 2 includes a side portion discharging unit 42. As a result, it is possible to reliably discharge the damp air, which includes a large amount of moisture and was sent to the outer side of the width direction of the sheet-like substrate W by the second nozzle.

In addition, the first drying unit 31 is provided in the most lower stream side of the travelling direction A. Thus, the dryness of the sheet-like substrate W in the width direction can be enhanced evenly, immediately before the drying process is completed. Therefore, the unevenness of the drying in the width direction of the sheet-like substrate W can be reduced even further.

In addition, the first nozzle 33 and the second nozzle 51 provided on the floor part 24 of the dry space retaining structure 20 function as air flow supplying nozzles blowing air to the lower surface (i.e., the to-be-dried surface W2) of the sheet-like substrate W. The air flow provided by the first nozzle 33 and the second nozzle 51 makes the sheet-like substrate W float. As a result, the sheet-like substrate W can travel stably.

(Third Embodiment)

Figure 4A:
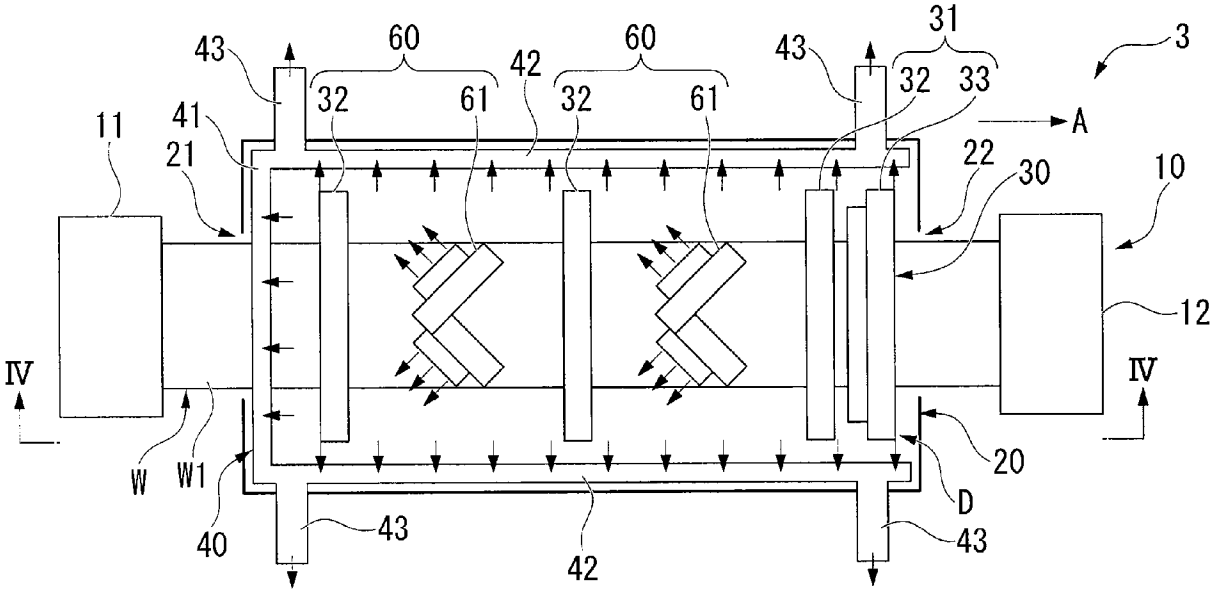
FIG. 4A is a skeletal configuration diagram (plane view) of a drying device 102 according to a third embodiment of the present invention.
Figure 4B:
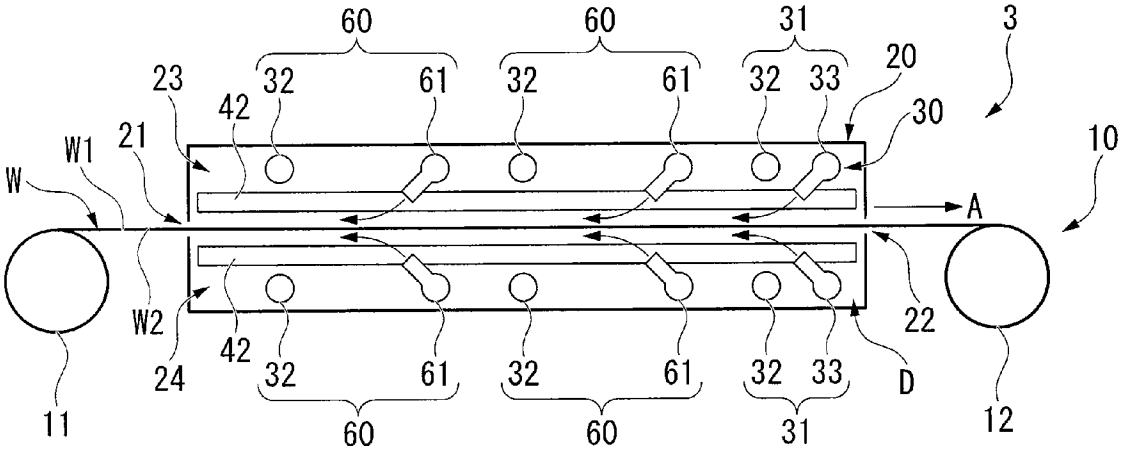
FIG. 4B is a skeletal configuration diagram (cross sectional view along line IV-IV) of a drying device 102 according to a third embodiment of the present invention.
Figure 5:
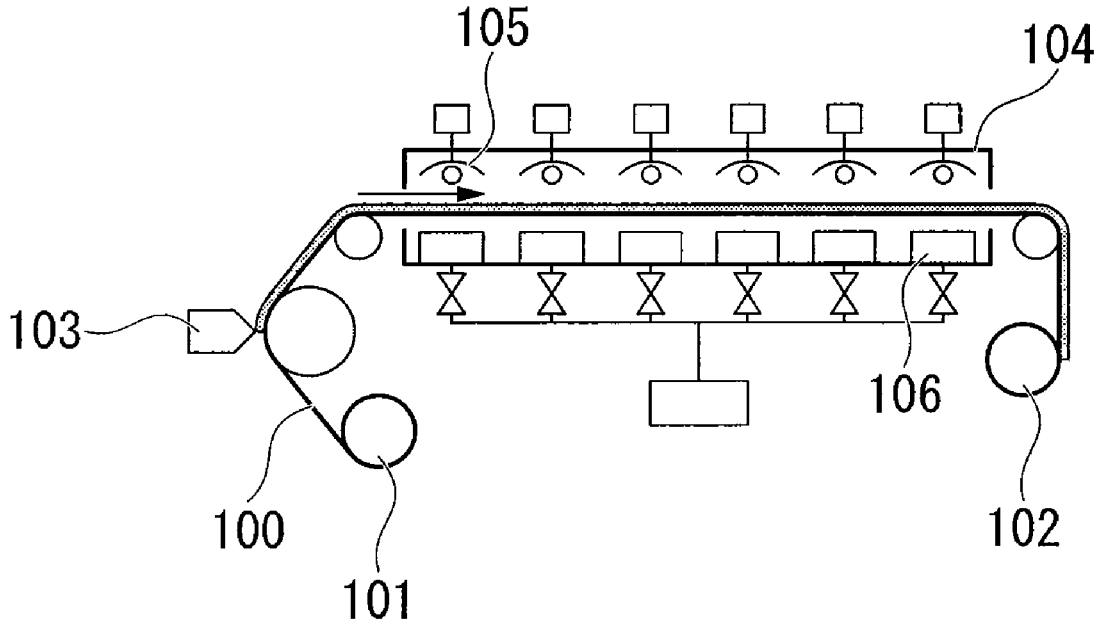
FIG. 5 is a drying device according to conventional art.

FIGS. 4A and 4B represent skeletal configuration diagrams of a drying device 3 according to a third embodiment of the present invention. FIG. 4A is a plane view, while FIG. 4B is a cross-sectional view along line IV-IV. Components which are included in FIGS. 4A-4B as well as FIGS. 1A-3B are referred to using the same reference numeral. Descriptions of overlapping components are omitted.

As shown in FIGS. 4A and 4B, the drying device 3 includes two second drying units 60 and one first drying unit 31 in each of the ceiling part 23 and the floor part 24 of the dry space retaining structure 20.

The second drying unit 60 includes a radiative heater 32 and a second nozzle 61.

The second nozzle 61 blows dry air to the to-be-dried surfaces W1 and W2.

As shown in FIG. 4A, the second nozzle 61 is shaped like the letter V from a plane view. An angular part of the second nozzle 61 is placed so as to overlap approximately with a central area in the width direction of the sheet-like substrate W, and the angular part is directed to the upper stream side. This second nozzle 61 blows dry air to the to-be-dried surfaces W1 and W2 from the interior portion of the sheet-like substrate W to the exterior portion along both sides of the sheet-like substrate W. In addition, the second nozzle 61 blows dry air to the to-be-dried surfaces W1 and W2 towards the upper stream side of the travelling direction A.

The amount of air blown from the second nozzle 61 is adjusted so that the second nozzle 61 on the floor portion 24 blows air to the to-be-dried surface W2, which is a lower surface of the sheet-like substrate W. Thus, the second nozzle 61 functions as an air flow supplying nozzle which allows the sheet-like substrate W to float.

The first drying unit 31 is placed on the most lower stream side in both the ceiling portion 23 and the floor portion 24 of the dry space retaining structure 20.

The drying device 3 is configured so that the dry air from the second nozzle 61 is blown in a direction opposite to the travelling direction of the sheet-like substrate W. The effects described in the second embodiment are attained by the drying device 3. In addition, the drying device 3 can reliably enhance the dryness of the sheet-like substrate W in the lower stream side of the travelling direction.

In addition, even if the evaporated moisture reattaches to the sheet-like substrate W, the moisture can be evaporated again with dry air. Air including the re-evaporated moisture can be sent to a direction opposite to the travelling direction of the sheet-like substrate W.

Accordingly, the unevenness of drying can be prevented more effectively. In addition, the drying process can be performed even more evenly and effectively.

In addition, the first nozzle 33 and the second nozzle 61 placed on the floor part 24 of the dry space retaining structure 20 can function as an air flow supplying nozzle which blows air to the lower surface (i.e., the to-be-dried surface W2) of the sheet-like substrate W. Due to the air flow supplied by the first nozzle 33 and the second nozzle 61, the sheet-like substrate W floats. Consequently, the sheet-like substrate W can be transported in a stable manner.

While a preferred embodiment of the present invention has been described above, it should be understood that these are exemplary of the invention and are not to be considered as limiting the present invention. Additions, omissions, substitutions, and other modifications can be made without departing from the spirit or scope of the present invention.

For example, in the second and third embodiments, the travelling unit 10 was not provided in the dry space D. However, the travelling unit 10 may be provided in the dry space D as in the drying device l' described in the variation of the first embodiment.

In addition, the first drying unit 31 and the second drying units 50 and 60 may be used cumulatively or individually.

Furthermore, the radiative heater 32 and the first nozzle 33 need not be used as the first drying unit 31. For example, a configuration is possible in which the first nozzle 33 is provided in a front portion of the ceiling part 23, and the radiative heater 32 is provided in the floor part 24 below. Similarly, the radiative heater 32 and the second nozzles 51 and 61 need not be used as the second drying units 50 and 60.

Moreover, the suction pressure of the air discharging device 40 may be enhanced. In addition, the direction in which the dry air blows can be adjusted.

What is claimed is:

1. A drying device comprising:

a travelling unit transporting a sheet-like substrate in a travelling direction, the sheet -like substrate comprising a thin film body wherein at least one surface of the thin film body is coated with a coating material comprising an active material; and a drying unit drying the thin film body, wherein the drying unit comprises a radiative heater irradiating an infrared ray to a to-be-dried surface of the thin film body;

a first nozzle blowing a dry air to the to-be-dried surface in a direction opposite to the travelling direction of the sheet-like substrate; and a second nozzle blowing a dry air to the to-be-dried surface from an inner side of a width direction perpendicular to the travelling direction of the sheet-like substrate towards an outer side of the width direction.

2. A drying device according to claim 1 further comprising a first air discharging unit in an upper stream side of the travelling direction, wherein the first air discharging unit discharges the dry air blown to the to-be-dried surface.

3. A drying device according to claim 1 further comprising a first drying unit, the first drying unit comprising:

the radiative heater provided in an upper stream side of the travelling direction; and the first nozzle provided in a lower stream side of the travelling direction.

4. A drying device according to claim 1 further comprising a plurality of first drying units provided in series along the travelling direction.

5. A drying device according to claim 1 further comprising a second drying unit, the second drying unit comprising:

the radiative heater provided in an upper stream side of the travelling direction; and the second nozzle provided in a lower stream side of the travelling direction.

6. A drying device according to claim 5 further comprising a plurality of second drying units provided in series along the travelling direction.

7. A drying device according to claim 1 further comprising a second air discharging unit in the outer side of the width direction of the sheet-like substrate, wherein the second air discharging unit discharges the dry air blown to the to-be-dried surface.

8. A drying device according to claim 5 further comprising a first drying unit, the first drying unit comprising:

the radiative heater provided in the upper stream side of the travelling direction; and the first nozzle provided in the lower stream side of the travelling direction, wherein the first drying unit is provided in a lower stream side of the travelling direction compared to the second drying unit.

9. A drying device according to claim 1 further comprising an air flow supplying nozzle blowing an air to a lower surface of the sheet-like substrate.

10. A drying device according to claim 1, wherein the drying unit is provided inside a dry space retaining structure forming a dry space in which the thin film body is dried.

11. A drying device according to claim 10, wherein the travelling unit is provided inside the dry space retaining structure.

* * * * *